US005446349A

United States Patent [19]

Bocan et al.

[11] Patent Number: 5,446,349

[45] Date of Patent: Aug. 29, 1995

[54] STROBE CIRCUIT UTILIZING OPTOCOUPLER IN DC-TO-DC CONVERTER

[75] Inventors: Kenneth J. Bocan, Ocean; David M. Stuntz, Ocean Grove, both of N.J.

[73] Assignee: Wheelock Inc., Long Branch, N.J.

[21] Appl. No.: 240,863

[22] Filed: May 10, 1994

[51] Int. Cl.[6] ..... H05B 37/00

[52] U.S. Cl. ..... 315/241 S; 315/241 P; 340/331

[58] Field of Search ..... 315/241 S, 240, 241 P, 315/241 R, 245, 219, 127, 307, 200 A; 340/331, 326, 332; 354/145.1, 413, 416

[56] References Cited

U.S. PATENT DOCUMENTS

| | | | |
|---|---|---|---|
| 4,572,991 | 2/1986 | Cote | 315/240 |
| 4,742,328 | 5/1988 | Arai et al. | 340/326 |
| 4,775,821 | 10/1988 | Sikora | 315/219 |
| 4,779,027 | 10/1988 | Sikora | 315/127 |
| 4,952,906 | 8/1990 | Buyak et al. | 315/241 S X |
| 4,967,177 | 10/1990 | Nguyen | 340/326 |
| 5,121,033 | 6/1992 | Kosich | 315/241 R |
| 5,128,591 | 7/1992 | Bocan | 315/241 S |

*Primary Examiner*—Ali Neyzari
*Attorney, Agent, or Firm*—Brumbaugh, Graves, Donohue & Raymond

[57] ABSTRACT

A strobe alarm circuit which utilizes an optocoupler in the DC-to-DC converter portion of the circuit for repetitively connecting and disconnecting an energy-storing inductor across a DC power source. The light-emitting diode portion of the optocoupler is connected in parallel with a resistor network which continuously monitors the current flowing through the inductor; when the inductor current has attained a value at which the sum of the voltages developed across the resistors of the network is sufficient to turn on the LED, the switch portion of the optocoupler is turned on and disconnects the inductor from across the source. A thermistor connected in parallel with one of the resistors of the resistor network compensates for changes in values of the elements of the optocoupler which may occur due to temperature changes.

6 Claims, 1 Drawing Sheet

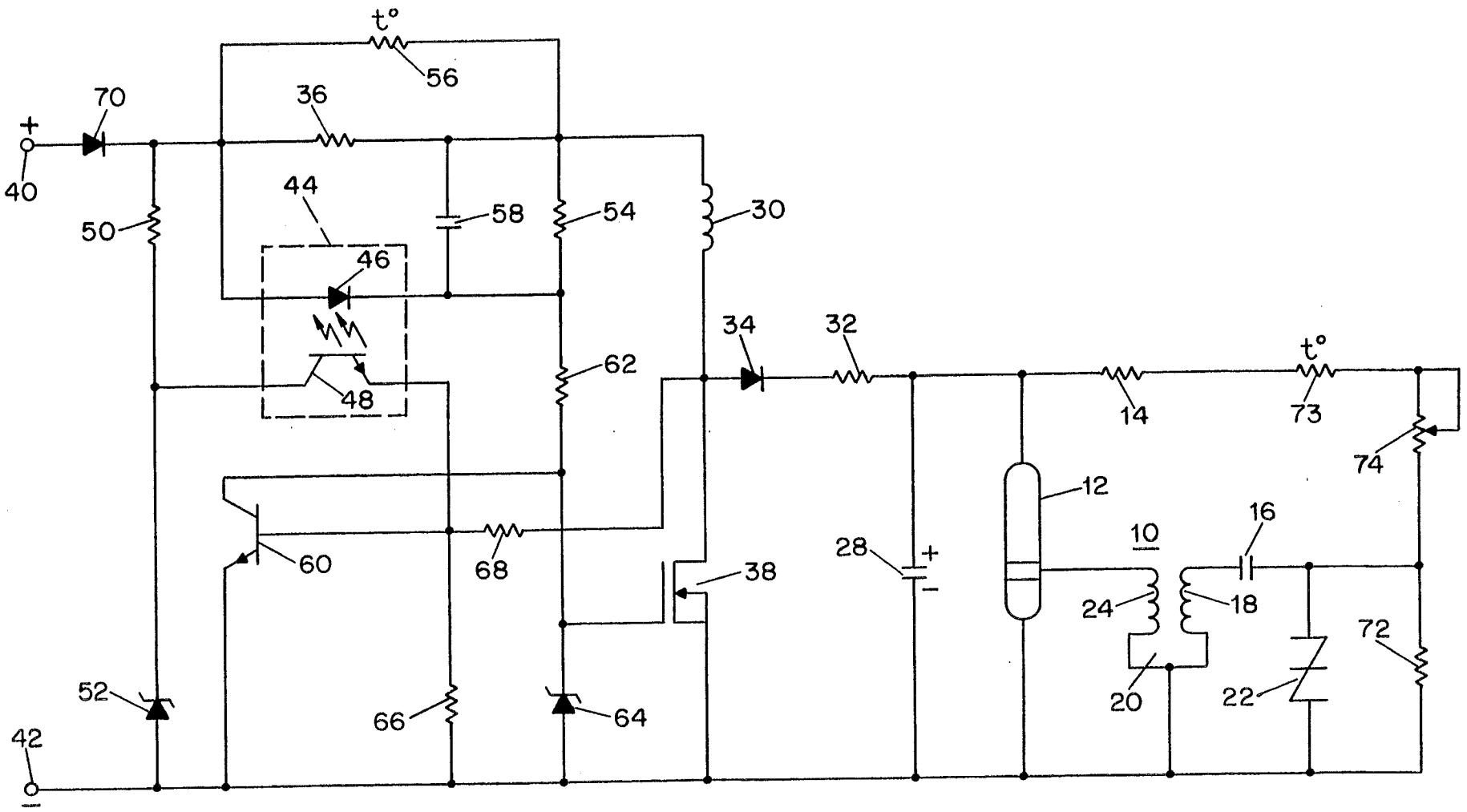
74
72
t°
73
16
18
22
10
14
20
24
12
+
-
28
32
30
34
38
54
62
64
58
68
56
66
t°
46
48
36
44
60
70
50
52
+
40
42
-

STROBE CIRCUIT UTILIZING OPTOCOUPLER IN DC-TO-DC CONVERTER

BACKGROUND OF THE INVENTION

This invention relates to circuits for electronic strobe lights such as are used to provide visual warning in electronic fire alarm devices and other emergency warning devices. Such devices are frequently associated with audible warning devices such as horns, and provide an additional means for getting the attention of persons who may be in danger. The strobe light commonly utilized in such systems in a gaseous discharge tube the firing of which is initiated by a trigger circuit which forms part of the flash unit. Energy for the flash typically is supplied from a capacitor connected in shunt with the flash unit and occurs when the voltage across the flash unit exceeds the threshold firing voltage required to actuate the trigger circuit. After the flashtube is triggered, it becomes conductive and rapidly discharges the shunt capacitor until the voltage across the flashtube has decreased to a value at which the flashtube extinguishes and becomes nonconductive.

Typically, such strobe alarm circuits are designed to be operative whether energized from a DC source or from a full-wave rectified input and include a DC-to-DC converter, an inductor coupled to the capacitor connected in parallel with the flash unit, and a switching circuit for connecting and disconnecting the inductor across the DC source to store energy in the inductor during closed periods of the switch and to transfer stored energy from the inductor to the storage capacitor during open periods of the switch. In most applications, it is necessary to miniaturize the circuitry, including the DC-to-DC converter, to the maximum extent possible so that it can be installed inside the lens of the strobe light. Also, the cost of the circuit desirably is kept as low as possible and at the same time its efficiency and reliability must be as high as possible, even when exposed to extreme environmental conditions.

U.S. Pat. No. 5,121,033, assigned to the same assignee as the present application, describes a strobe circuit exhibiting these properties in which the DC-to-DC converter portion of the circuit utilizes an optocoupler for controlling closing and opening of a switch for repetitively connecting and disconnecting an energy-storing inductor across a DC power source. The light-emitting diode portion of the optocoupler is connected in parallel with a resistor connected in series with the inductor for continuously monitoring the current flowing through the inductor; when the inductor current has attained a value at which the voltage drop across the resistor is sufficient to turn on the LED, the switch portion of the optocoupler is turned on and actuates a switch which disconnects the inductor from across the source. After a short interval determined by the parameters of the optocoupler and associated circuitry, the cycle is repeated.

While this prior circuit limits the peak current flowing through the inductor to a relatively constant predetermined value over a range of variations in amplitude of the supply voltage, there is a need for better regulation of input power and flash rate over the operating input voltage range of the energizing source, whether it is a DC source or a full-wave rectified source.

SUMMARY OF THE INVENTION

It is a primary object of the present invention to improve the DC-to-DC converter of the strobe alarm circuit described in the aforesaid patent to provide better regulation of input power and flash rate of the strobe light over a range of input voltages and to improve efficiency of operation of the circuit.

Another object of the invention is to achieve such improved operation with a minimum number of additional inexpensive, miniaturized, reliable components.

Briefly, in the strobe circuit according to the present invention, a DC-to-DC converter circuit receives an input voltage from a DC or full-wave rectified source, the amplitude of which may vary over a predetermined operating range, and intermittently connects and disconnects an inductor across the source to store energy in the inductor during periods of connection. During periods when the inductor is disconnected from across the source, energy stored in the inductor is coupled to a capacitor connected in parallel with a flash unit. The DC-to-DC converter includes an optocoupler consisting of a light-emitting diode (LED) and a photosensitive transistor which is rendered conducting in response to conduction of the LED, and a network of current-sensing resistors connected in series with the inductor. The resistor network includes series-connected first and second current-sensing resistors connected in parallel with the LED of the optocoupler and a thermister connected in parallel with the first current-sensing resistor. As current flows through the resistors to charge the inductor, the voltages developed across the series-connected resistors of the network increase until their sum is sufficient to turn on the LED, the conduction of which, in turn, opens a switch connected in series with the inductor to disconnect the inductor from across the source, whereupon energy is coupled from the inductor to the capacitor coupled to the flash unit. In the event the input voltage increases from a nominal level, the resulting increase in current through the second resistor increases the voltage drop developed across it at the time of turn on of the LED, which forces the voltage drop across the first resistor to be lower at the time of LED turn on, because the sum of the voltages across the first and second resistors when the LED turns on must equal the conduction threshold voltage of the LED. This means that the peak current required to develop this lower voltage across the first resistor is lowered, with an attendant lowering of average input current. The negative temperature coefficient of the thermistor compensates for the fact that the "on" voltage of the LED decreases with increases in temperature which would otherwise result in a lower input current for a given source voltage, leading to a slowing of the rate at which the energy storage capacitor is charged and at which the flashtube is fired.

BRIEF DESCRIPTION OF THE DRAWING

Other objects, features and advantages of the invention will become apparent and its construction and operation better understood, from the following detailed description, taken in conjunction with the accompanying drawing, the single FIGURE of which is a schematic circuit diagram of a preferred embodiment of the invention.

DESCRIPTION OF THE PREFERRED EMBODIMENT

In the drawing a flash unit 10 is shown as including a flashtube 12 shunted by a trigger circuit which includes a resistor 14 connected in series with the combination of a SIDAC 22 connected in parallel with the series combination of a capacitor 16 and the primary winding 18 of an autotransformer 20. The secondary winding 24 of autotransformer 20 is connected to the trigger band 26 of the flashtube 12 so that when the voltage across the flashtube exceeds its threshold firing voltage, SIDAC 22 will break down and storage capacitor 16 will discharge through autotransformer 20 and thereby cause the flashtube to become conductive. The flashtube will quickly discharge the energy stored in capacitor 28 so that the capacitor can be recharged by the DC-to-DC converter of the invention.

To ensure that the flashtube is triggered at virtually the same instant as the voltage across the capacitor 28 exceeds the trigger threshold value, a resistor divider network, which is described and claimed in co-assigned patent application Ser. No. 08/031,947 (Applegate, Kosich and Curran) is included in the trigger circuit. The network includes a potentiometer 74, which can be adjusted at the factory, to compensate for electrical element value variations due to stated tolerances and a thermistor 73 to compensate for electrical element value variations due to temperature fluctuations. More particularly, the network includes the series connection of resistor 14, thermistor 73, potentiometer 74 and resistor 72 connected in parallel with capacitor 28 and flashtube 12, with SIDAC 22 connected in parallel with resistor 72. It will be appreciated that resistor 14 may not be necessary since potentiometer may be of a high resistance, but the inclusion of resistor 14 allows the resistance of potentiometer 74 to be low enough to allow for fine adjustment of the resistor divider network.

The capacitor 28 is incrementally charged from an inductor 30 which is connected to the positive terminal of the capacitor through a resistor 32 connected in series with a diode 34. The inductor 30 is repetitively connected and disconnected across a power source represented by terminals 40 and 42, which may be either DC or a full-wave rectified voltage, by closing and opening a switch 38 connected in series with the inductor. In the illustrated embodiment, switch 38 is a MOSFET, but other forms of switch may be used. Opening and closing of switch 38 is controlled by an optocoupler 44, which may be a Motorola Type 4N37 optoisolator consisting of a gallium-arsenide infrared-emitting diode 46 optically coupled to a monolithic silicon phototransistor detector 48. The voltage at the collector electrode of the transistor portion 48 is established by a voltage divider consisting of a resistor 50 and a Zener diode 52 connected in series across the power source. The rate at which switch 38 is opened and closed which, in turn, determines the rate at which increments of energy are transferred from inductor 30 to capacitor 28, is determined by a resistor network consisting of a first resistor 36 connected in series with inductor 30, a second resistor 54 series-connected with resistor 36 across LED 46, a negative temperature coefficient thermistor 56 connected in parallel with resistor 36, and a resistor 62 connected in series with resistor 54 and a Zener diode 64 for providing a current path for resistor 54 when the LED is not conducting and for turning Zener diode 64 on. A capacitor 58 connected in parallel with resistor 54 forms a filter for filtering the signal developed across resistor 54 in the event the circuit is powered by a full-wave rectified input signal.

Such filtering decreases the average current of the circuit for full-wave rectified inputs by raising the average voltage across resistor 54, which forces the voltage across resistor 36 to be lower at LED 46 turn-on, resulting in a lowering of the average current. This filtering decreases the average current to DC inputs in the same manner, but to a lesser extent than for full-wave rectified inputs. Since the circuit having no capacitor 58 will draw much greater currents with full-wave rectified inputs than with DC inputs, capacitor 58 will provide circuit performance with full-wave rectified inputs that more closely matches that achieved with a DC input.

As current commences to flow through the resistor divider network upon closure of switch 38 to charge the inductor 30, the voltage developed across resistor 36 increases until the sum of voltages across resistor 36 and resistor 54 equals the conduction threshold voltage of LED 6, approximately 1.2 volts for the 4N37 optoisolator, whereupon the LED is turned "on" and illuminates and turns "on" transistor 48, which, in turn initiates closure of switch 38. Switch 38 is turned off and on by an intermediate switch 60, which may be a transistor having its emitter connected to the negative terminal 42 of the power supply, its collector connected to the junction between resistor 62 and Zener diode 64, and the base of which is connected to the emitter of the transistor 48 of optocoupler 44, and to the junction of a pair of series-connected resistors 68 and 66 connected in parallel with switch 38. Resistor 50 and Zener diode 52 clamp the collector of the transistor portion 48 of the optocoupler to a specific voltage independent of the input voltage and allow only a small amount of current to flow through the transistor 48 of the optocoupler. Resistors 66 and 68 form a voltage divider which helps switch transistor 60 "on" (and thus switch 38 "off") when switch 48 of the optocoupler turns "on" and current is coupled through diode 34 and resistor 32 to charge capacitor 28. The diode 34 being "on" at this point, the high potential of capacitor 28, which may be on the order of 30 volts or greater, is fed back to reinforce the turn off of switch 60. The feedback path consisting of resistors 66 and 68 insures that all of the charge stored in inductor 30 during the closed periods of switch 38 is transferred to capacitor 28 before switch 60 turns off to again begin the inductor charging cycle. The intermediate switch 60 connected between optocoupler 44 and the gate of switch 38 makes for a clean switching wave form, which improves circuit efficiency by reducing the amount of heat dissipated in switch 38.

In operation, as power is initially applied to the circuit, the LED 46 and transistor 48 of the optocoupler are both "off", causing switch 60 to also be "off" which, in turn, causes switch 38 to be turned "on" to connect inductor 30 across the power source and initiate charging of inductor 30 and a buildup of current flow through an isolating diode 70 and the divider network of resistors 36 and 54. When the charging current flowing through inductor 30 has attained a value sufficient to cause the sum of the voltages appearing across resistors 36 and 54 to be approximately 1.2 volts, the conduction threshold voltage of the LED, the LED is turned "on" and illuminates transistor 48 to turn it "on", causing current to flow through and develop a voltage across resistor 66 which turns "on" transistor 60. Closing of switch 60 causes switch 38 to open and thus disconnect inductor 30 from across the input voltage source. During the open "off" period of switch 38, energy stored in inductor 30 is coupled through diode 34 and resistor 32 to capacitor 28. Upon cessation of current flow through resistors 36 and 54 due to the opening of switch 38, the sum of the voltages developed across the network is insufficient to keep LED 46 on, the transistor portion 48 stops conducting and turns transistor 60 "off" which, in turn, again turns switch 38 "on" and the cycle is repeated.

The divider network consisting of resister 36 and 54 is designed to maintain the average input current at minimum level regardless of variations in the value of the source voltage, or whether it is DC or a full-wave rectified voltage. At a nominal input voltage of, say, 24 volts, the voltages developed across the divider network cause the optocoupler to turn "on" and "off" at a predetermined rate in response to an average input current. In the event the input voltage increases from this nominal level, the resulting increase in the current through resistor 54 causes the voltage drop developed across resistor 54 to be larger at the time of turn "on" of LED 46 which, in turn, forces a the voltage drop across resistor 36 to decrease when the LED turns "on", since the sum of the voltages across resistors 36 and 54 when the LED turns "on" must equal the conduction threshold voltage of the LED. This means that the peak current required to develop this reduced voltage across resistor 36 is also lowered, resulting in a lowering of average input current.

The incorporation of thermistor 56 in the resistor divider network solves another problem which has been observed with the operation of the prior art flash circuit: the conduction threshold voltage of LED 46 decreases with increases in temperature, which means that a lower input current will turn the LED on, thus slowing the rate at which capacitor 28 charges and at which flashtube 12 is fired. Negative temperature coefficient thermistor 56 connected in parallel with resistor 36 compensates for this effect: as the temperature rises, the resistance of thermistor 56 decreases, allowing more current to flow to inductor 30 and negating the effect of decreasing conduction threshold voltage of the LED.

The connecting and disconnecting periods of switch 38 are determined primarily by the switching characteristics of the optocoupler, the values of resistors 36 and 54, the value of the inductor 30, and the voltage of the DC source, and may be designed to cycle at a frequency in the range from about 3,000 Hz to about 17,500 Hz. The repetitive opening and closing of switch 38 will eventually charge capacitor 28 to the point at which the voltage across it attains the threshold value required to fire the flashtube. As mentioned previously, when that point is reached, SIDAC 22 breaks down and causes a trigger pulse to be applied to trigger band 26 to trigger flashtube 12 into conduction and producing a flash.

By way of example, the illustrated circuit, designed to be energized from a 24 volt power source, either a DC voltage or a full-wave rectified voltage subject to amplitude variation, may use the following parameters for the circuit elements to obtain a flash frequency of sixty flashes per minute.

| Element | Value or No. |
|---|---|
| diode 70 | 1N4007 |
| diode 34 | HER106 |

-continued

| Element | Value or No. |
|---|---|
| resistor 32 | 27 ohms |
| resistor 36 | 1.91 ohms |
| resistor 54 | 200 ohms |
| resistor 56 | thermistor |
| resistors 50, 62, 66 | 10K |
| resistor 68 | 1 megohm |
| inductor 30 | 2.7 mH |
| capacitor 28 | 100 microfarads |
| capacitor 16 | .047 microfarads |
| switch 38 | 1RF710 |
| switch 60 | 2N4401 |
| Zeners 52 and 64 | 1N5236B |
| flashtube 12 | DS1 |
| optocoupler 44 | 4N37 |

While the type 4N37 optoisolator has been described and specified in the foregoing chart, other optocouplers such as the Motorola Type MOC3012 optoisolator consisting of a gallium-arsenide infrared-emitting diode optically coupled to a silicon bilateral switch designed for applications requiring isolated triac triggering, may be used instead. Also, switch 30 may be a transistor instead of the indicated MOSFET.

While a particular embodiment of the invention has been shown, it will be understood that the invention is not limited thereto since modifications may now be made by those skilled in the art. It is, therefore, intended by the following claims to cover any such modifications which come within the spirit and scope of the invention.

We claim:

1. A strobe circuit for flashing a flashtube at a desired rate, comprising:

a power voltage source having first and second terminals for providing a voltage subject to amplitude variations;

an inductor connected in an electrical path between said first and second terminals of said voltage source;

a flash circuit coupled to said inductor which includes a flashtube, a first capacitor connected in parallel with the flashtube, and a trigger circuit being operable to fire the flashtube to generate a light output upon said first capacitor being charged to a voltage corresponding to the threshold firing voltage of the flashtube;

switch means in said electrical path for electrically connecting and disconnecting said inductor to said power source to store energy in said inductor during periods of connection and causing energy to be coupled from said inductor to said first capacitor during periods of disconnection by said switch means; and means for repetitively cycling said switch means between an open and a closed state comprising optocoupler means including a light-emitting diode optically coupled to a phototransistor, a resistor network including a first resistor series—connected with a second resistor in parallel with said light-emitting diode, said first resistor being connected in said electrical path between said inductor and said power source, said second resistor being operable in response to an increase in the amplitude of the source voltage to decrease the voltage contribution required from said first resistor at the time said light-emitting diode is turned on thereby to decrease the average input current, wherein said strobe circuit initiates the open period of said switch means in response to the current flowing through the network attaining a value at which the voltage developed across the network is sufficient to turn on the light-emitting diode and initiates the closed period of said switch means in response to the value of the current flowing through said network being insufficient to keep the light-emitting diode turned on, the resistor network ensuring a flashing rate of the flashtube which is substantially independent of variations in amplitude of source voltage.

2. The strobe circuit of claim 1 wherein a thermistor is connected in parallel with said first resistor for compensating for changes in values of electrical elements in said optocoupler which may occur due to temperature changes.

3. The strobe circuit of claim 1 wherein said means for repetitively recycling said switch means includes a second capacitor connected in parallel with said second resistor of said resistor network and therewith forming a filter for filtering a full-wave rectified input voltage from said power source.

4. The strobe circuit of claim 1 wherein said means for repetitively cycling said switch means includes intermediate switch means connected between the phototransistor of said optocoupler and said switch means for improving the switching wave form of said switch means.

5. The strobe circuit of claim 1 wherein said first terminal of said power voltage source is positive and said second terminal is negative.

6. The strobe circuit of claim 1 wherein said first resistor is connected in series between said first terminal and said inductor.

* * * * *